US010356517B2

(12) United States Patent
Shultz et al.

(10) Patent No.: US 10,356,517 B2
(45) Date of Patent: Jul. 16, 2019

(54) BLENDED PASSIVE MICROPHONE

(71) Applicant: Marshall Electronics, Inc., Torrance, CA (US)

(72) Inventors: Leonard Marshall Shultz, Torrance, CA (US); Steven Silva, Los Angeles, CA (US)

(73) Assignee: Marshall Electronics, Inc., Torrance, CA (US)

( * ) Notice: Subject to any disclaimer, the term of this patent is extended or adjusted under 35 U.S.C. 154(b) by 0 days.

(21) Appl. No.: 15/230,526

(22) Filed: Aug. 8, 2016

(65) Prior Publication Data

US 2018/0041832 A1 Feb. 8, 2018

(51) Int. Cl.

| | |
|---|---|
| ***H04R 3/00*** | (2006.01) |
| ***H04R 1/08*** | (2006.01) |
| *H04R 1/04* | (2006.01) |
| *H04R 9/08* | (2006.01) |
| *H04R 5/027* | (2006.01) |
| *H04R 5/04* | (2006.01) |

(52) U.S. Cl.

CPC ..... *H04R 3/005* (2013.01); *H04R 1/086* (2013.01); *H04R 1/04* (2013.01); *H04R 1/083* (2013.01); *H04R 5/027* (2013.01); *H04R 5/04* (2013.01); *H04R 9/08* (2013.01); *H04R 2420/01* (2013.01); *H04R 2420/09* (2013.01); *H04R 2430/01* (2013.01)

(58) Field of Classification Search

CPC combination set(s) only.

See application file for complete search history.

(56) References Cited

U.S. PATENT DOCUMENTS

| | | | | |
|---|---|---|---|---|
| 3,110,769 | A * | 11/1963 | Bertram | H04S 1/002 323/367 |
| 3,944,759 | A * | 3/1976 | Penning | H04R 1/08 381/355 |
| 6,081,603 | A * | 6/2000 | Engh | H03G 1/007 330/282 |
| 6,441,292 | B1 | 8/2002 | Donnell | |
| 6,627,808 | B1 | 9/2003 | Coats et al. | |
| 7,015,390 | B1 | 3/2006 | Rogers | |
| 7,024,006 | B1 * | 4/2006 | Schwartz | H04R 25/00 381/71.1 |
| 7,271,332 | B2 | 9/2007 | Clark | |
| 7,433,704 | B2 * | 10/2008 | Ono | H04M 1/0214 379/93.37 |
| 8,035,025 | B1 | 10/2011 | Donnell | |
| 8,748,724 | B1 | 6/2014 | Harmon | |
| 8,884,150 | B2 | 11/2014 | Swanson | |
| 8,940,993 | B1 | 1/2015 | Micek | |
| 2002/0073830 | A1 * | 6/2002 | Petherick | G10H 3/181 84/726 |
| 2005/0175189 | A1 * | 8/2005 | Lee | H04M 9/082 381/92 |
| 2007/0006718 | A1 * | 1/2007 | Clark | G10H 1/08 84/736 |

(Continued)

*Primary Examiner* — Duc Nguyen
*Assistant Examiner* — Assad Mohammed
(74) *Attorney, Agent, or Firm* — Welsh Flaxman & Gitler LLC

(57) ABSTRACT

A blended passive microphone includes a dynamic first microphone, a dynamic second microphone, and a blending circuit adjusting outputs of the dynamic first microphone and the dynamic second microphone.

4 Claims, 6 Drawing Sheets

(56) References Cited

U.S. PATENT DOCUMENTS

| | | | | |
|---|---|---|---|---|
| 2009/0186503 | A1* | 7/2009 | Dobler | H01R 27/00<br>439/172 |
| 2010/0111337 | A1* | 5/2010 | Silber | H04R 5/04<br>381/309 |
| 2013/0058507 | A1* | 3/2013 | Arkn S-Pedersen | G10H 1/348<br>381/122 |

* cited by examiner

BLENDED PASSIVE MICROPHONE

BACKGROUND OF THE INVENTION

1. Field of the Invention

The present invention generally relates to a microphone used in conjunction with a guitar, instrument or vocal production. More particularly, the invention relates to a blended passive microphone including two microphones, for example, a large dynamic capsule microphone and a smaller dynamic microphone, wherein the outputs of the respective dynamic microphones are adjusted via a dual gang potentiometer.

2. Description of the Related Art

Microphones for use with guitars and other instruments require power and are commonly inconvenient to use. As such, a need exists for a microphone that does not require a power source, that is totally passive, and may be conveniently and reliably used in conjunction with guitars, other instruments and vocal productions.

SUMMARY OF THE INVENTION

It is, therefore, an object of the present invention to provide a blended passive microphone including a dynamic first microphone, a dynamic second microphone, and a blending circuit adjusting outputs of the dynamic first microphone and the dynamic second microphone.

It is also an object of the present invention to provide a blended passive microphone including a housing member in which components of the blended passive microphone are supported.

It is another object of the present invention to provide a blended passive microphone wherein the dynamic first microphone includes a dynamic microphone cartridge and a first microphone output.

It is a further object of the present invention to provide a blended passive microphone wherein the dynamic second microphone includes a dynamic microphone cartridge and a second microphone output.

It is also an object of the present invention to provide a blended passive microphone wherein the blending circuit includes a dual gang potentiometer.

It is another object of the present invention to provide a blended passive microphone wherein the blending circuit includes an XLR cable output for connection to an audio pro mixer or microphone input on audio accessory equipment.

It is a further object of the present invention to provide a blended passive microphone wherein the XLR cable output is a three-pin XLR cable output.

It is also an object of the present invention to provide a blended passive microphone wherein the blending circuit includes a first input electrically coupled to the POS & NEG outputs of the dynamic first microphone and a second input electrically coupled to the POS & NEG outputs of the dynamic second microphone.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
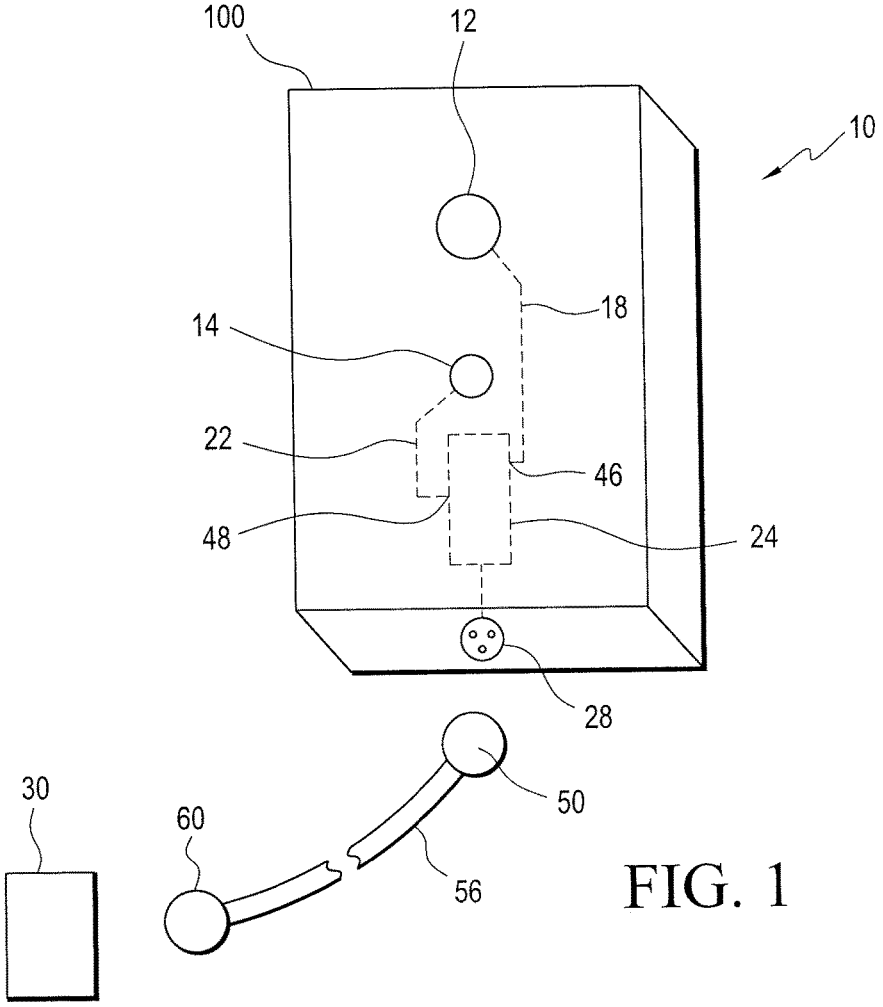
FIG. 1 a schematic of the present blended passive microphone.
Figure 2A:
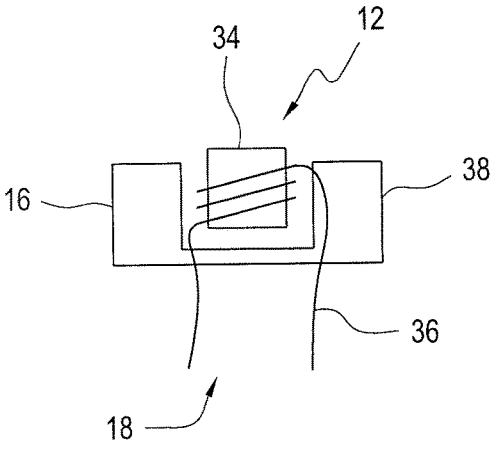
FIGS. 2A and 2B are respectively side schematic views of the dynamic first microphone and the dynamic second microphone of the blended passive microphone.
Figure 2B:
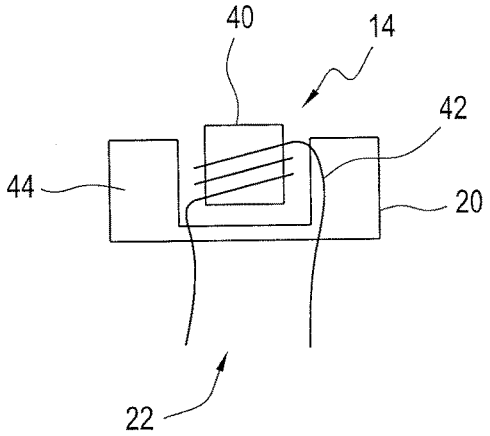
Figure 3:
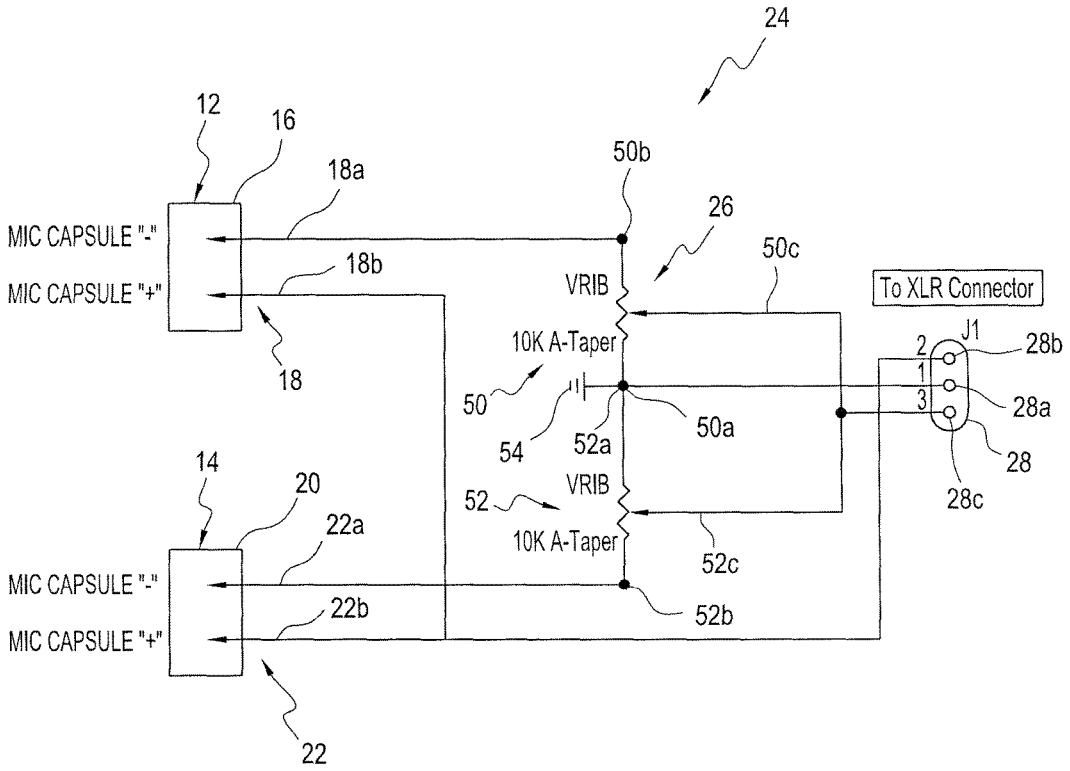
FIG. 3 is a circuit diagram of the blending circuit of the blended passive microphone.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Referring to the various figures a blended passive microphone 10 requiring no voltage is disclosed. The blended passive microphone 10 is adapted for use in conjunction with guitars, other instruments, and/or vocal productions. The blended passive microphone 10 of the present invention is constructed to be mounted upon a microphone stand, or may even be handheld, and provides a fully balanced sound signal that is transmitted to an audio mixer or audio accessory equipment via a cable.

The blended passive microphone 10 of the present invention includes a dynamic first microphone 12 and a dynamic second microphone 14. The dynamic first microphone 12 is a large dynamic capsule microphone and includes a dynamic microphone cartridge 16 and a first microphone output 18. The dynamic second microphone 14 is a small dynamic capsule microphone and includes a dynamic microphone cartridge 20 and a second microphone output 22.

Figure 4:
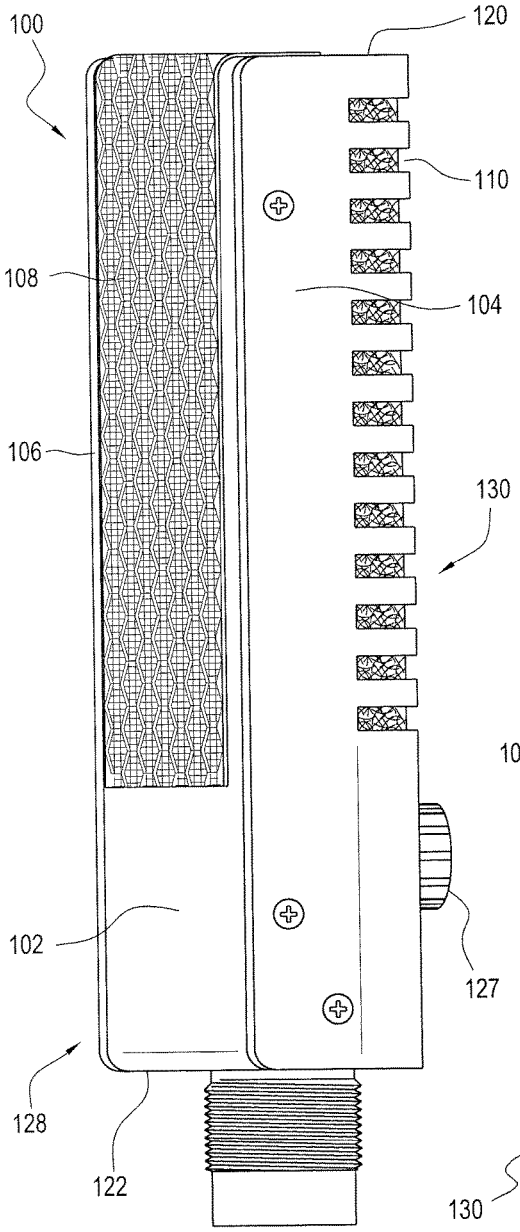
FIGS. 4 and 5 are respectively a side view and a perspective view of the housing member of the blended passive microphone in accordance with a preferred embodiment.
Figure 5:
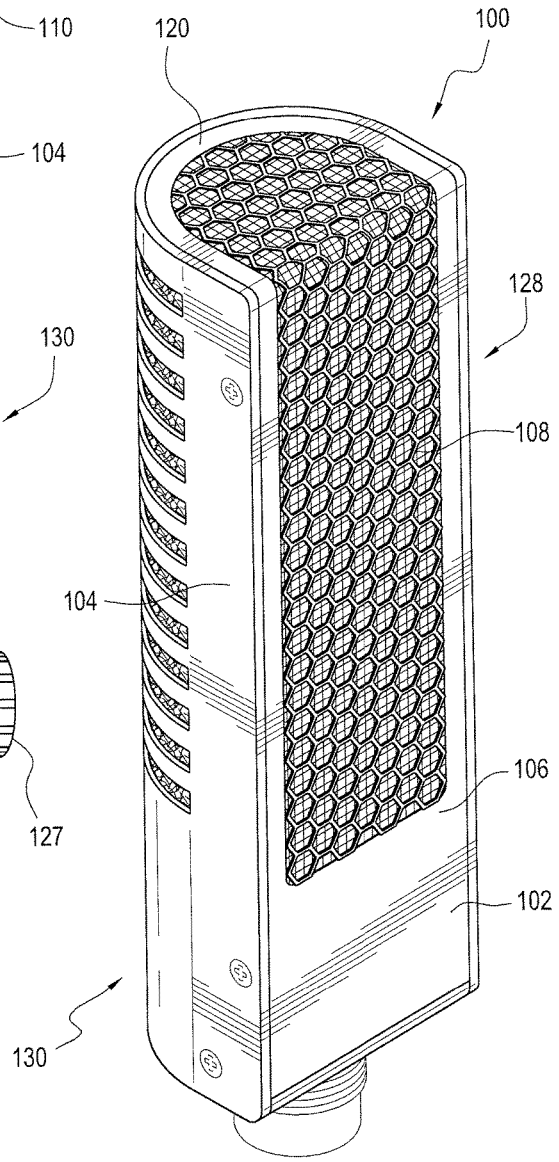
Figure 6D:
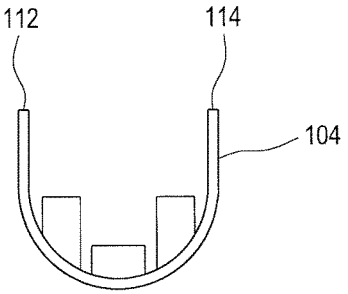
FIGS. 6A, 6B, 6C, and 6D are respectively a front view, a left side view, a right side view and a top view of the rear wall of the housing member.
Figure 6B:
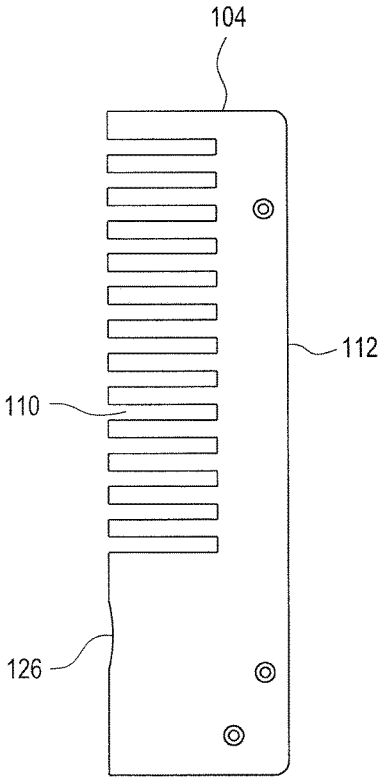
Figure 6A:
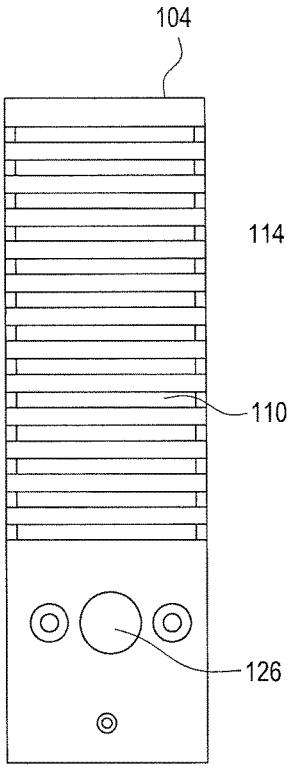
Figure 6C:
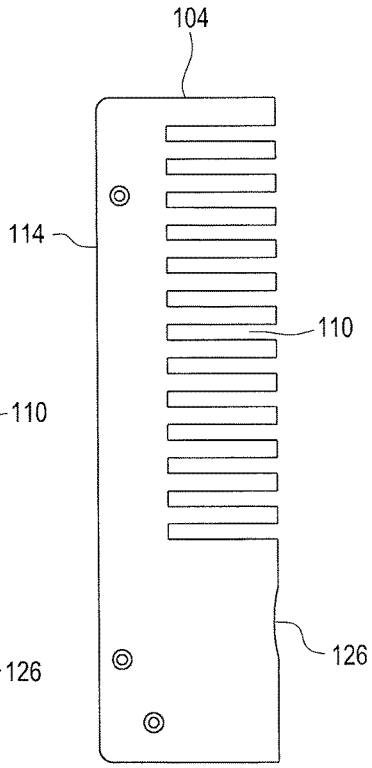
Figure 7A:
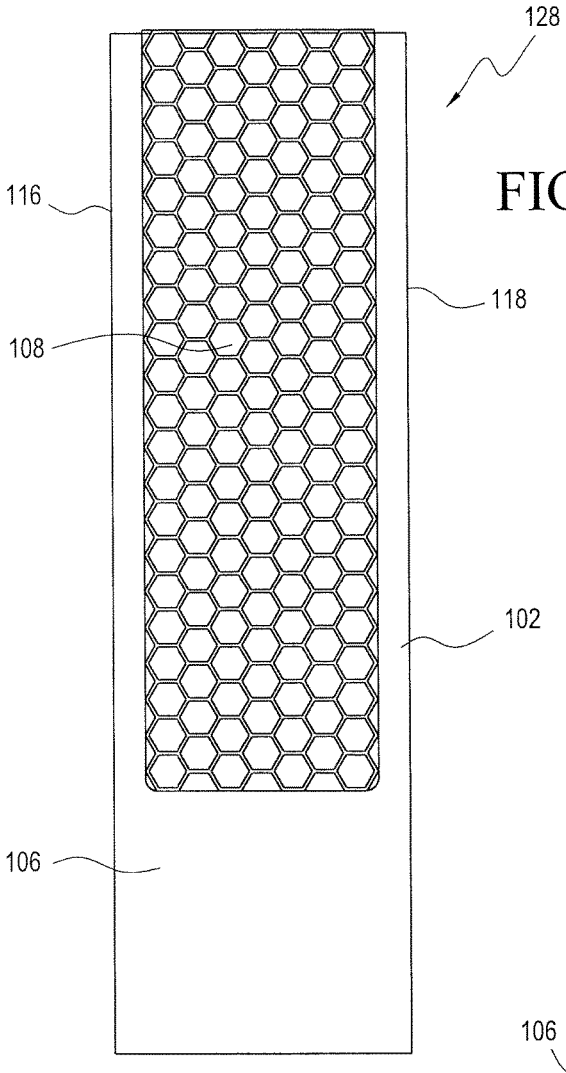
FIGS. 7A, 7B, 7C, 7D, and 7E are respectively a front view, a top perspective view, another perspective view, a side view and a top view of the front enclosure of the housing member.
Figure 7B:
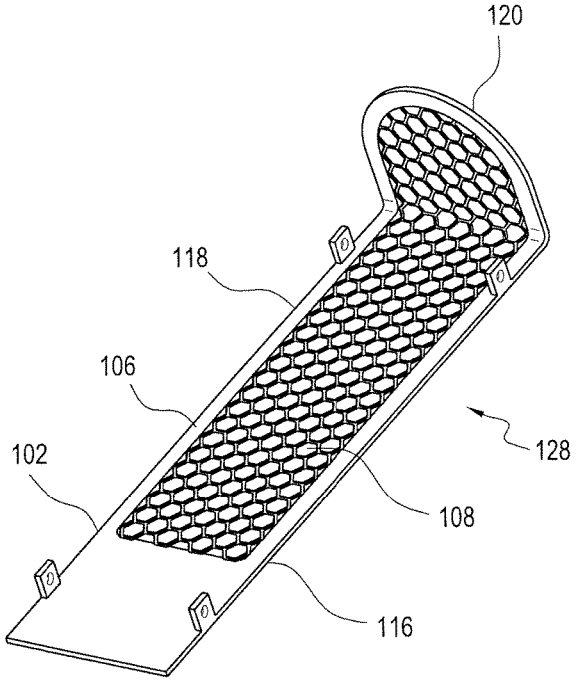
Figure 7C:
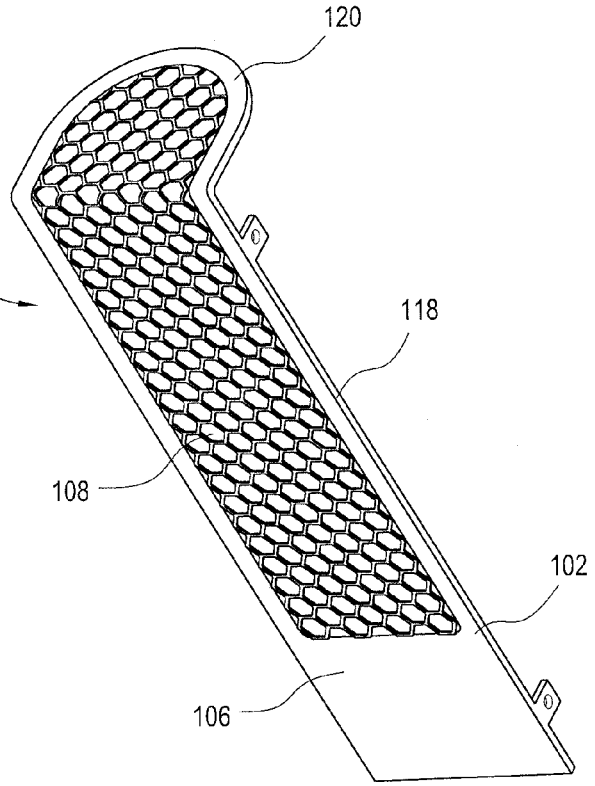
Figure 7D:
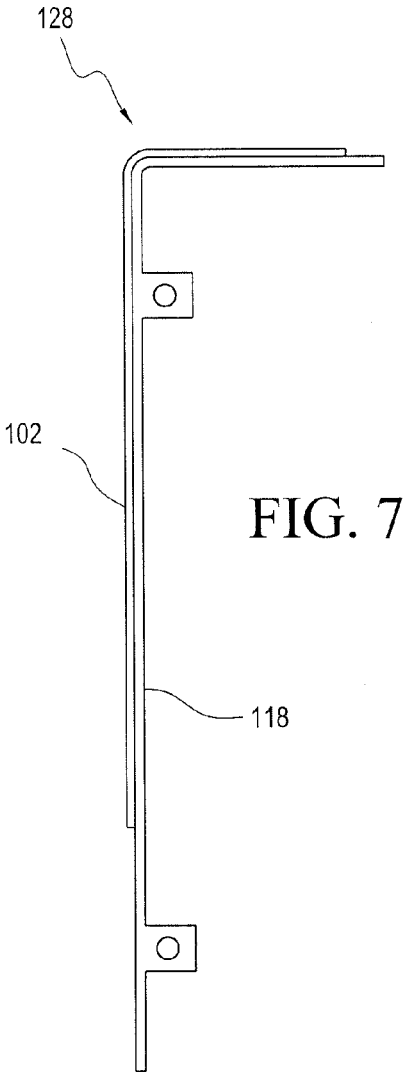
Figure 7E:
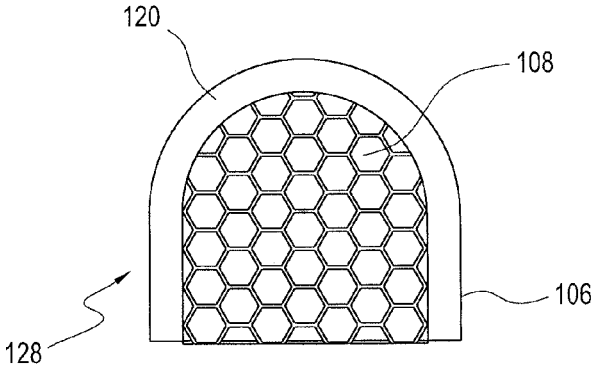

The first microphone output 18 and the second microphone output 22 are coupled to a blending circuit 24. The blending circuit 24 includes a dual gang potentiometer 26 that is used to adjust outputs of the dynamic first microphone 12 and the dynamic second microphone 14. The dual gang potentiometer 26 is adjusted using a knob 127 (as shown in FIG. 4 and as is known to those skilled in the art). The blending circuit 24 has an XLR cable output 28 for connection to any audio pro mixer or microphone input on any audio accessory equipment 30.

The components of the blended passive microphone 10 as described above are supported with a housing member 100. It is appreciated the housing member 100 may take a variety of forms without departing from the spirit of the present invention. In accordance with a preferred embodiment, and with reference to FIGS. 4, 5, 6A-D, and 7A-E, the housing member 100 includes a flat front wall 102 and an arcuate rear wall 104. As will be explained below in greater detail, the front wall 102 includes a solid frame 106 within which is mounted a perforated grill 108 allowing for the passage of sound waves therethrough. The housing member 100 also includes the rear wall 104 that has a plurality of perforations/slots 110 allowing for the flow of air necessary to cool the internal components of the blended passive microphone 10.

In addition to the perforations/slots 110 allowing the flow of air, the rear wall 104 includes a central circular aperture 126 shaped and dimensioned for the positioning of the control knob 127 of the dual gang potentiometer 26 allowing for selective balancing of the present blended passive microphone 10. As those skilled in the art will appreciate, the knob 127 controls the dual gang potentiometer 26 (in particular, the first and second potentiometers 50, 52 as discussed below) for adjusting the resultant outputs of the dynamic first and second microphones 12, 14.

The rear wall 104 is arcuate and includes first and second lateral edges 112, 114 that extend about the perimeter of the rear wall 104 such that the first and second lateral edges 112, 114 respectively meet the first and second lateral side walls 116, 118 of the front wall 102 so as to provide for secure attachment thereof in the manufacture of the housing member 100. In addition, the housing member 100 includes a top wall 120 and a bottom wall 122. The top wall 120 and the bottom wall 122 complete the enclosure and ensure the formation of a complete housing member 100.

In accordance with a preferred embodiment, the top wall 120 is integrally formed with the front wall 102, while the bottom wall 122 is a separate piece that is attached to the rear wall 104 during manufacture. The bottom wall 122 is provided with an aperture 124 shaped and dimensioned for the passage and/or connection of electrical wires. With this in mind, the top wall 120 and front wall 102 may be thought of as forming a front enclosure member 128, and the bottom wall 122 and rear wall 104 may be thought of as forming a rear enclosure member 130. With regard to the front enclosure member 128, it should be noted that the frame 106 and perforated grill 108 also form the top wall 120 such that sound coming from either directly in front of the blended passive microphone 10 or slightly above the blended passive microphone 10 will freely access the functional components thereof.

While the preferred embodiment discloses a multi-part housing member which is secured together utilizing screws and other attachment mechanisms, it is contemplated the housing member may be formed in a variety of manners without departing from the spirit of the present invention.

In addition to the apertures for the transmission of sound, the front wall includes a central circular aperture shaped and dimensioned for the positioning of a control knob allowing for selective balancing of the present blended passive microphone.

As briefly mentioned above, the dynamic first microphone 12 of the present blended passive microphone 10 is a large dynamic microphone (preferably having a cartridge with a diameter of 28 mm or greater) and includes a dynamic microphone cartridge 16 and a first microphone output 18. The first microphone output 18 is composed of positive (POS) output 18*a* and negative (NEG) output 18*b*. The dynamic first microphone 12 has a Frequency Response of 50 Hz-14 kHz, a Sensitivity of −52 dB at 1 Volt/Pascal, and an Impedance of 400 ohms. As those skilled in the art will appreciate, a dynamic microphone works based upon the principle of magnetic induction. That is, and in accordance with the present invention, dynamic first microphone 12 converts acoustic energy in the form of sound waves into an electric signal using a dynamic microphone cartridge 16. The dynamic microphone cartridge 16 includes a diaphragm 34 attached to a coil 36 which moves back and forth within a strong magnetic field 38. The magnetic field 38 causes an electric current to flow through the coil 36, with a voltage which varies in synchronization with the motion of the diaphragm. The dynamic first microphone 12 requires no external power or battery to run. However, and as will be appreciated based upon the following disclosure, signals generated by the blended passive microphone 10 of the present invention are ultimately amplified and processed by audio mixers and other audio processing equipment 30 that might be used in accordance with the present invention.

The dynamic second microphone 14 is a small dynamic microphone (preferably having a cartridge with a diameter of 22 mm or less) and includes a dynamic microphone cartridge 20 and a second microphone output 22. The second microphone output 22 is composed of POS output 22*a* and NEG output 22*b*. The dynamic second microphone 14 has a Frequency Response of 100 Hz-12 kHz, a Sensitivity of −54 dB at 1 Volt/Pascal, and an Impedance of 600 ohms. As such, and as with the large dynamic first microphone 12, the small dynamic second microphone 14 converts acoustic energy in the form of sound waves into an electric signal using the dynamic microphone cartridge 20. The dynamic microphone cartridge 20 includes a diaphragm 40 attached to a coil 42 which moves back and forth within a strong magnetic field 44. The magnetic field 44 causes an electric current to flow through the coil 42, with a voltage which varies in synchronization with the motion of the diaphragm 40. The small dynamic second microphone 14 requires no external power or battery to run. However, and as will be appreciated based upon the following disclosure, signals generated by the blended passive microphone 10 of the present invention are ultimately amplified and processed by audio mixers and other audio processing equipment 30 that might be used in accordance with the present invention.

The first microphone output 18 and the second microphone output 22 are coupled to a blending circuit 24. The blending circuit 24 includes the dual gang potentiometer 26 that adjusts outputs 18, 22 of the dynamic first microphone 12 and the dynamic second microphone 14.

More particularly, the blending circuit 24 includes a first input 46 electrically coupled to the POS & NEG outputs 18*a*, 18*b* of the first microphone output 18 and a second input 48 electrically coupled to POS & NEG outputs 22*a*, 22*b* of the second microphone output 22. The first and second inputs 46, 48 are electrically connected to the dual gang potentiometer 26, which has an XLR cable output 28 for connection to any audio pro mixer or mic input on any accessory equipment 30.

The dual gang potentiometer 26 includes a first potentiometer 50 and a second potentiometer 52. In accordance with a preferred embodiment, both the first and second potentiometers 50, 52 provide a 10 k taper log and may be adjusted under the control of knob 127 in a manner well known to those skilled in the art.

The first potentiometer 50 includes first, second and third pins 50*a*, 50*b*, 50*c*. The first pin 50*a* is connected to ground 54, the second pin 50*b* is connected to the POS output 18*a* of the first microphone output 18 via the first input 46 of the blending circuit 24, and the third pin 50*c* is connected to the XLR cable output 28 of the blending circuit 24 (in particular, the third pin 28*c* of the XLR cable output 28 of the blending circuit 24). Similar, second potentiometer 52 includes first, second and third pins 52*a*, 52*b*, 52*c*. The first pin 52*a* is connected to ground 54, the second pin 52*b* is connected to the POS output 22*a* of the second microphone output 22 via the second input 48 of the blending circuit 24, and the third pin 52*c* is connected to the XLR cable output 28 (in particular, the third pin 28*c* of the XLR cable output 28).

As discussed above, the blending circuit 24 includes an XLR cable output 28 adapted for connection to a single three-pin XLR cable 56. As is well appreciated, XLR cables are commonly used in conjunction with professional audio equipment, and include first and second connectors 58, 60 having a plurality of pins (in accordance with the present invention a three-pin connection is employed). In fact, three-pin XLR connectors are by far the most common style, and are an industry standard for balanced audio signals.

With this in mind, and as briefly discussed above, the XLR cable output 28 of the blending circuit 24 includes a third pin 28*c* that is connected respectively to the third pins 50*c*, 52*c* of the first and second potentiometers 50, 52. The first pin 28*a* of the XLR cable output 28 of the blending circuit 24 is connected to ground 54 and the second pin 28*b* of the XLR cable output 28 of the blending circuit 24 is connected respectively to the NEG outputs 18*b*, 22*b* of the first and second microphone outputs 18, 22 (via the first and second inputs 46, 48 of the blending circuit 24). In this way, XLR cable output 28 of the blending circuit 24 provides a blended audio signal that may be used by an audio pro mixer or any audio accessory equipment 30. By employing an XLR cable output 28, the present blending circuit 24 provides a balanced signal, that is, the shield of the cable is connected to ground while the audio signals (from the first and second potentiometers 50, 52 as well as directly from the first and second microphone outputs 18, 22) flow in two conductors which are not connected to ground.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A blended passive microphone that does not require a power source, comprising:

a dynamic first microphone including first microphone POS & NEG outputs;

a dynamic second microphone including second microphone POS & NEG outputs;

a blending circuit adjusting outputs of the dynamic first microphone and the dynamic second microphone, the blending circuit includes a cable output and a dual gang potentiometer including a first potentiometer and a second potentiometer, the first potentiometer includes first, second and third pins, wherein the first pin is connected to ground, the second pin is connected to the first microphone POS output via a first input of the blending circuit, and the third pin is connected to the cable output, the second potentiometer includes first, second and third pins, wherein the first pin is connected to ground, the second pin is connected to the second microphone POS output via a second input of the blending circuit, and the third pin is connected to the cable output, and the cable output directly connected to the first microphone NEG output and the second microphone NEG output; and a housing in which the dynamic first microphone, the dynamic second microphone and the blending circuit are positioned.

2. The blended passive microphone according to claim 1, wherein the dynamic first microphone and dynamic second microphone each include a dynamic microphone cartridge.

3. The blended passive microphone according to claim 1, wherein the cable output is an XLR cable output for connection to an audio pro mixer or microphone input on audio accessory equipment.

4. The blended passive microphone according to claim 3, wherein the XLR cable output is a three-pin XLR cable output.

* * * * *